US005964209A

United States Patent [19]

Boehner

[11] Patent Number: 5,964,209

[45] Date of Patent: Oct. 12, 1999

[54] VOLLEYBALL SERVING APPARATUS

[76] Inventor: Douglas L. Boehner, P.O. Box 9330, Truckee, Calif. 96132

[21] Appl. No.: 08/995,951

[22] Filed: Dec. 22, 1997

Related U.S. Application Data

[60] Provisional application No. 60/033,545, Dec. 23, 1996.

[51] Int. Cl.[6] ..... F41B 3/04

[52] U.S. Cl. ..... 124/78

[58] Field of Search ..... 124/6, 78, 81

[56] References Cited

U.S. PATENT DOCUMENTS

| | | | |
|---|---|---|---|
| 4,323,048 | 4/1982 | Saito et al. | 124/78 |
| 4,325,351 | 4/1982 | Yuasa | 124/78 |
| 4,561,414 | 12/1985 | Nozato | 124/78 |
| 4,841,945 | 6/1989 | Braden | 124/78 |
| 5,012,790 | 5/1991 | Bates | 154/81 |
| 5,464,208 | 11/1995 | Pierce | 124/78 X |

*Primary Examiner*—John A. Ricci
*Attorney, Agent, or Firm*—Charles Hartman

[57] ABSTRACT

The volleyball service device of this invention includes; a base member for supporting the structure; a support member attached to the base member extending upwardly from the base member and forming an angle with the base member to extend increasingly over the center of gravity of the base member; a server head for propelling volleyballs forward; and a trolley attached to the server head to vertically reposition the server head relative to the support member. In a preferred embodiment the volleyballs are propelled forward by a plurality of rotating wheels.

14 Claims, 3 Drawing Sheets

VOLLEYBALL SERVING APPARATUS

RELATED APPLICATIONS

This application claims the benefit of the filing date of Provisional Patent Application 60/033,545 filed Dec. 23, 1996.

BACKGROUND OF THE INVENTION

1. Field of the Invention

This invention relates to apparatus for improving performance in sports; in particular, this apparatus relates to apparatus for improving performance in the sport of volleyball, more particularly, this invention relates to apparatus for serving volleyballs for practice.

2. State of the Art

For decades now various sports have used devices to simulate the actions of the sport to aid the athlete in perfecting his performance during playing the sport in actual competition. One of the best known of such devices is the baseball pitching machine. Varieties of this general type of device exist, and they aide in the development of expertise in hitting the base ball.

Similar devices exist for tennis coaching. The ball is served and the student returns the serve. One such device for volleyball is described in U.S. Pat. No. 4,323,048 issued to Saito et al. It discloses a volleyball practice apparatus having a serving head that propels the ball forward by a pair of rotating wheels. The height is adjusted in this embodiment by raising and lowering the server head which is mounted on a vertical member. The problem with this approach is that the entire apparatus tends to become unstable as the server head is raised higher.

Although it would seem to be a trivial exercise to modify either of the two types of device for volleyball two major difficulties arise. First, volleyballs are physically much larger than either tennis balls or baseballs. Second, for the workout to reliably benefit the student serves, spikes and other returns must be simulated. The problem is that the ball must be served from as high a position as possible to simulate the various activities of the serve. Overcoming those problems has proven to be harder than anticipated.

SUMMARY OF THE INVENTION

This invention provides a vertically repositionable volleyball practice server.

One aspect of this invention is a volleyball service device comprising;

a base member for supporting the structure;

a support member attached to the base member extending upwardly from the base member and forming an angle with the base member to extend increasingly over the center of gravity of the base member;

a server head for propelling volleyballs forward; and a means attached to the server head to vertically reposition the server head relative to the support member.

A second aspect of this invention is a volleyball service device wherein the server head is removably attached to the device.

A third aspect of this invention is a volleyball service apparatus comprising:

a base member;

a volleyball server comprising;

a mounting frame;

at least one driven rotating wheel having a first driving surface, a first axis of rotation and a first plane of rotation attached to the mounting frame;

a second wheel having a second driving surface, a second plane of rotation attached to the mounting frame, wherein the first plane of rotation and the second plane of rotation are substantially the same, and the first axis of rotation and the second axis of rotation are offset enough to allow a sphere the approximate size of a volleyball to contact the driving surface of the first wheel and the second driving surface of the second wheel simultaneously; and a feeding station suitable mounted on the mounting frame to allow placing volleyballs in wheel accessible position thereby allowing the driven rotating wheel and the second wheel to propel the volleyballs forward in the direction of volleyball travel;

a support having the frame vertically rotatably and horizontally rotatably attached thereto; and means for vertically repositioning the volleyball server attached to the base and to the volleyball server comprising;

a support inclined away from the direction of volleyball travel and inclined over the base member;

a bracket means vertically repositionable on the support mounted thereto; and a resilient means attached to the base member disposed in parallel orientation to the support, the resilient means allowing the support to maintain a selected vertical position and the support frame positioning the server nearer the center of the base member as the server is repositioned farther from the base member.

DETAILED DESCRIPTION OF THE PREFERRED EMBODIMENT

Figure 1:
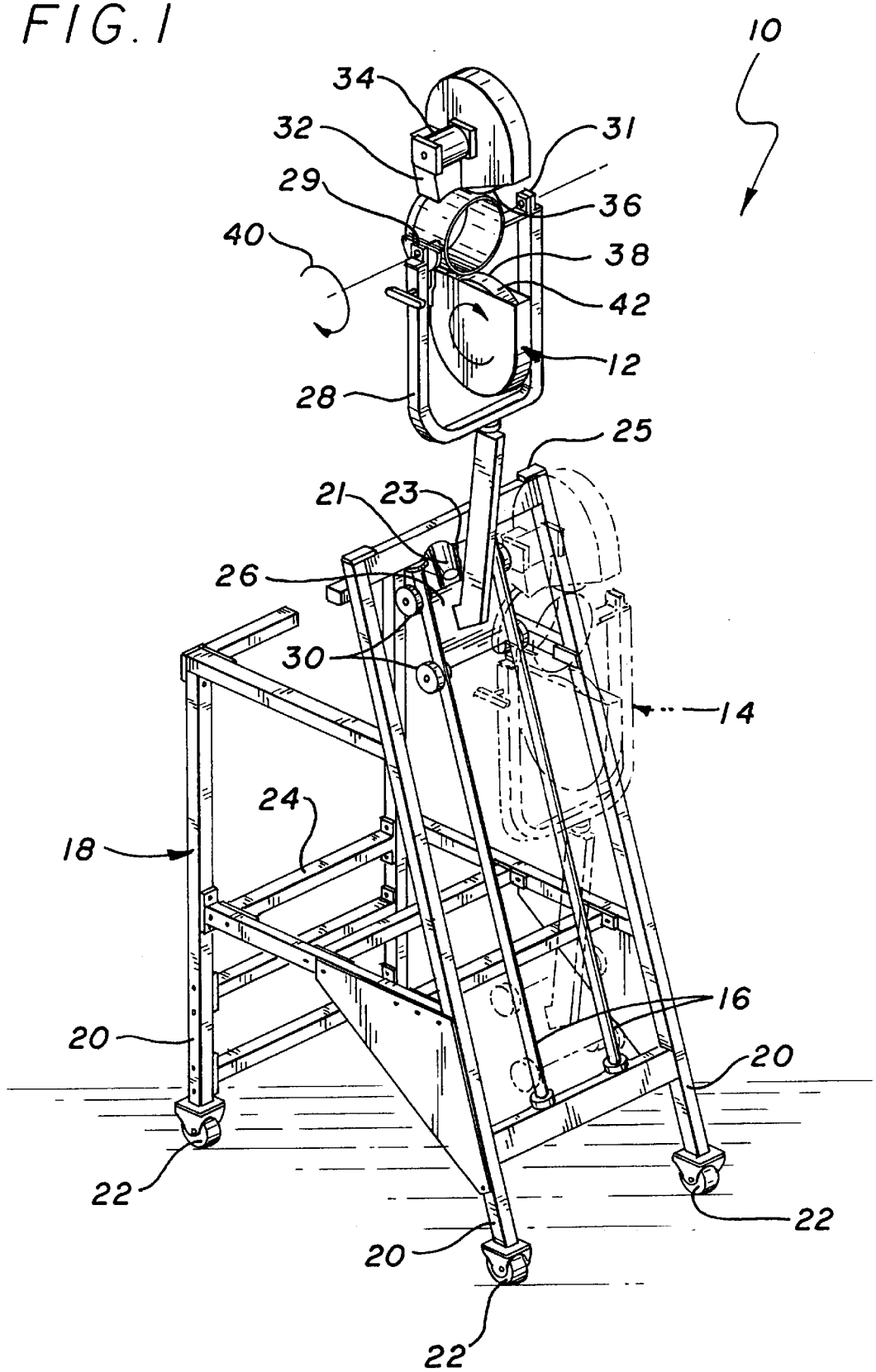
FIG. 1 is a perspective view of an embodiment of this invention including a phantom view of the server head in two positions.

Referring to FIG. 1, in one embodiment of the invention, a volleyball serving apparatus 10 having a serving head 12, a means for vertically repositioning the head 14, parallel vertical support bars 16 and a base 18. Generally, the base comprises a plurality of legs 20 with castors 22, and a raised platform 24 for a coach or ball re-loader to stand on. The server head can 12, in this embodiment be repositioned by raising or lowering the means for vertically repositioning the head moving it along the parallel vertical support bars.

The means for vertically repositioning the head includes a wheeled trolley 26, the parallel vertical support bars 16, a bracket 28 to hold the head in position, and the server head 12 removably attached to the bracket. The wheeled trolley has two pairs of wheels 30 that engage the parallel vertical support bars 16. A biasing means 21, here an elastic cord 23 is attached to the trolley 26 and the frame 25 of the apparatus, providing means to position the trolley at a desired height. The bracket 28 wraps around the server head 12 and is attached to the server head in two places 29 and 31.

The volleyball server head has a mounting frame 32. The server head has a first axis of rotation and a second axis of rotation is attached to the mounting frame. At least one driven rotating wheel 34, the first wheel, has a first driving surface 36. A second wheel 38 having a second driving surface 42 is also attached to the mounting frame. It is greatly preferred that the second wheel be independently driven from the first wheel. As shown in the drawing, the plane of rotation of the first wheel and the plane of rotation of the second wheel are substantially the same, although this is not a requirement, or even especially preferred. If the first and the Second wheels do not share a common plane of rotation, certain curves and other unusual trajectories can be readily obtained.

The first driving means 34 can be any conventional rotating driving motor, but a variable speed electric motor is greatly preferred, although other means such as pneumatically driven, or even reciprocating-to rotating motion can be used. As mentioned above, it is greatly preferred that the second wheel is also independently driven, again by the preferred conventional variable speed electric motor. When the first and second wheels are driven by variable speed electric motors, the speed of the second wheel can be varied relative to the first wheel.

Figure 2:
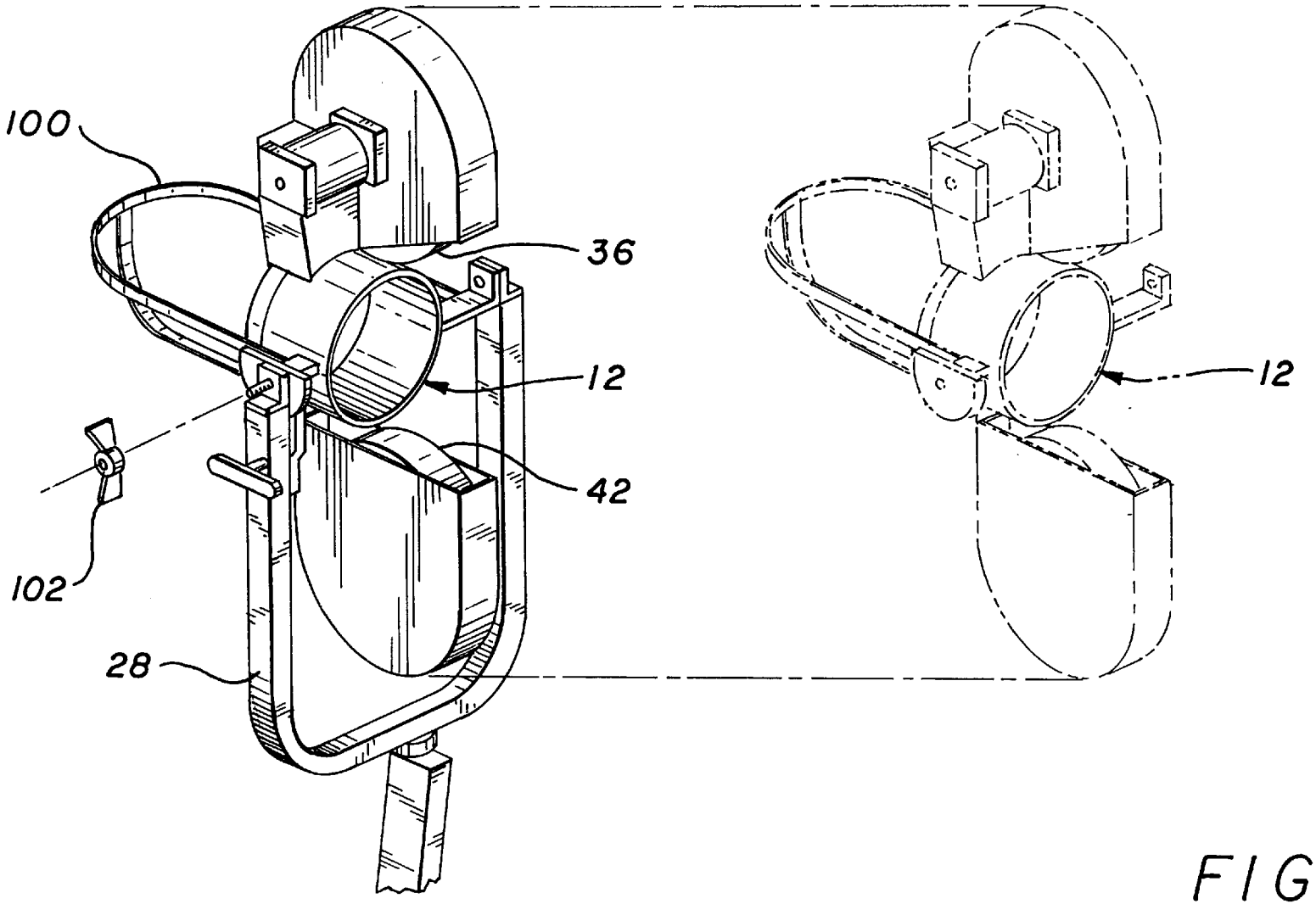
FIG. 2 shows a perspective view of a detail of FIG. 1 and another position of one of the components in phantom.

The base forms a platform that a person, a coach or another, may stand on to feed the balls into the server head, and to reposition the server head both vertically and around the vertical axis and the horizontal axis. This allows the players to have a realistic workout. The station where the feeder person stands is surrounded by a railing that protects the person from falling and allows him to hold on. A bag containing spare balls for use in the server head can be placed on the railing to allow a constant supply of volleyballs.i Referring now to FIG. 2, the server head 12 of this invention may be removed for storage or safekeeping. The server head 12 is attached to the bracket 28 by two removable means; screw means, for example, wing nuts 102 as shown, or conventional bolts, are preferred, but removable cotter-pins, spring loaded bolts, tongue and groove machined parts may all be used.

Also attached to the mounting frame is a feeding station 100 that allows placing volleyballs, or other spherical balls, in a position allowing the volleyballs to be accessible to the driving wheels 36 and 42 thereby allowing the driven rotating wheel and the second wheel to propel the volleyballs forward in the direction of volleyball travel.

The volleyball server of this invention is vertically repositionable to allow realistic serving, spiking, and defensive play. The serving head is mounted on a mounting arm tilted backwardly over the base of the device to center the mass of the serving head more directly over the center of the mass for the apparatus as the head is moved upwardly. Of course, as in the embodiment shown in FIG. 1, the base can, if desired, provide a platform for a coach or ball re-loader, or other interested person to stand on. The severing head is mounted on a movable trolley that runs up and down the arm. A counter-force means provides enough force to counter balance the force required to overcome the weight of the server head to allow the trolley to be moved upwardly on the arm without undue or exhausting force.

Figure 3:
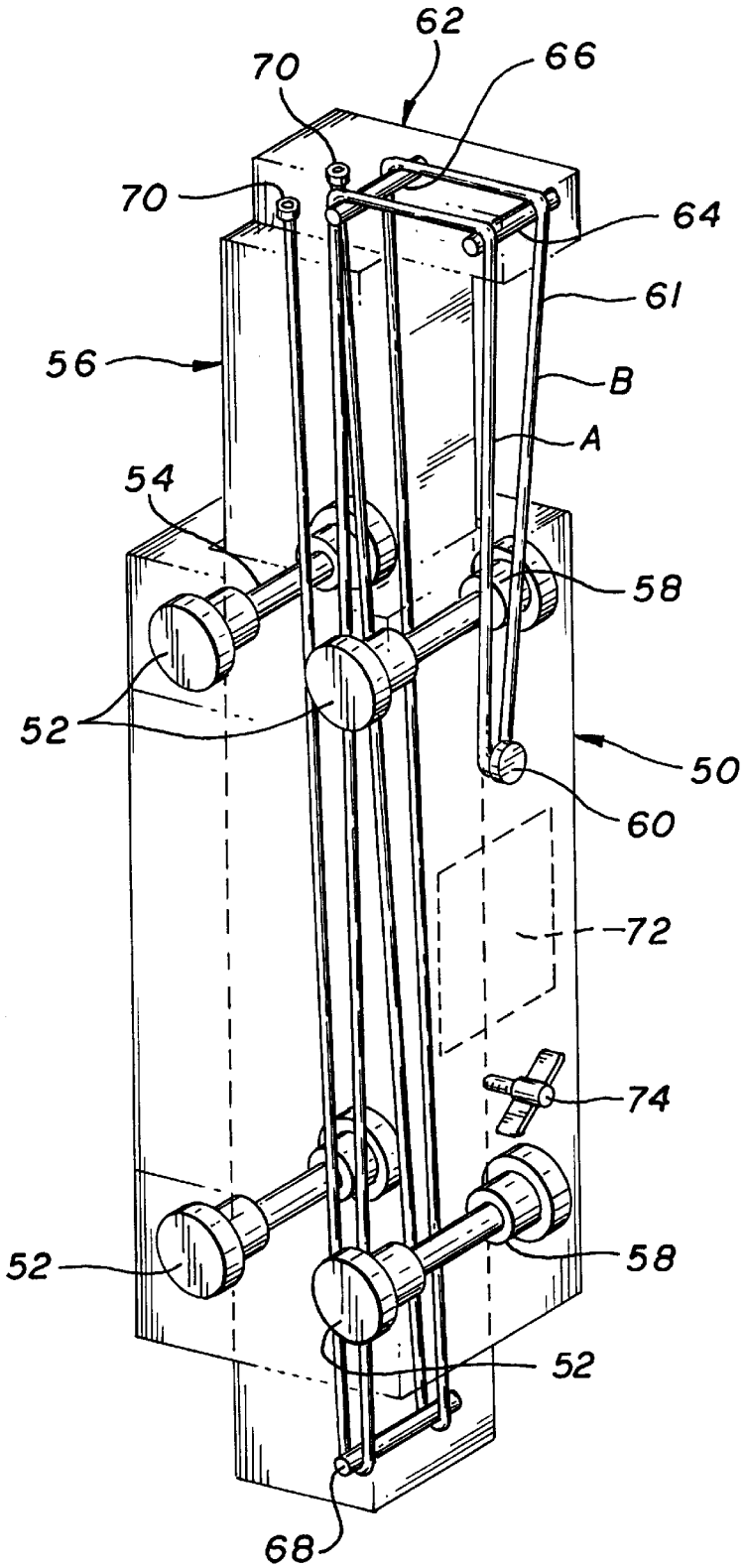
FIG. 3 is a perspective view of a detail of a second embodiment of this invention.

Referring now to FIG. 3 one possible alternative vertical repositioning means is shown. The apparatus shown in FIG. 3 would normally substitute for the parallel support bars shown in FIG. 1. Although the mounting arm 56 would normally be much longer, it is shortened in the FIG. for clarity's sake. As mounted, the mounting arm would, like the parallel arms of the embodiment shown in FIG. 1 be inclined over the base of the volleyball server, so that as the serving head is placed higher, the balance of the total apparatus is not adversely affected.

Here, a trolley 50 has a plurality of stepped wheels 52, connected by axles 54. The mounting 56 arm is contacted by the lesser diameter 58 (as shown) of the wheels, and the boundary between the wheels forms a rail member that firmly positions the trolley relative to the mounting arm. A cord receiving member 60 is mounted on the inside of the frame.

In a preferred embodiment, a resilient cord 61, one example being a bungee cord, is wrapped around the cord receiving member 60, to the top of the mounting arm 56 where a cord receiving member 62 having a first cord tension member 64 and a second cord tension member 66 is disposed. The tension members redirect the cord to the bottom of the mounting arm. The redirected cord then contacts and interacts with a third cord tension member 68 attached to the bottom of the mounting arm, which once again redirects the path of the cord. Finally, back at the cord receiving member 62, a cord anchoring member 70 firmly anchors the end of the cord to the cord receiving member.

It should be noted that the cord is doubled, that is both side A and side B of the cord are wrapped in this serpentine fashion around the mounting arm. Only one side of the doubled cord is shown in the drawing for clarity. The serpentine arrangement of the cord arrived at by the use of the cord tension members allows a thinner diameter of cord to be used that will still provide the needed amount of stretch as provided by a less serpentine arrangement using thicker cord. Thin cord is preferred because it is more easily stretched by the user, and particularly by children and women, than the thicker cord and provides less resistance to the user who is adjusting the position of the trolley while still supporting the combined weight of the trolley and the server head.

The bracket, such as 28 in FIG. 1, is mounted on the trolley at the mounting position 72 by such conventional means as screw members, or welding or similar conventional means. The trolley may be provided with a screw 74 or similar means to secure the trolley into position on the mounting arm.

This invention has been described by reference to preferred embodiments and specific examples. It should be appreciated that adaptations, modifications, and variations of the preferred embodiments will suggest themselves to those skilled in the art. The appended claims are intended to encompass all such adaptations, modificatons, and variations.

I claim:

1. A volleyball service device comprising:

a base member;

a support member attached to the base member extending upwardly from the base member and forming an angle with the base member to extend increasingly over the center of gravity of the base member;

a server head for propelling volleyballs forward, supported by the support member; and a means attached to the server head to vertically reposition the server head relative to the support member.

2. The volleyball service device of claim 1 wherein the means to vertically reposition the server head comprises a trolley.

3. The volleyball service device of claim 2 wherein the trolley is resiliently biased.

4. The volleyball service device of claim 3 wherein the trolley is biased by resilient biasing means selected from the group consisting of elastic cord, spring loading, and pulley guided cord.

5. The volleyball service device of claim 2 wherein the support member comprises a rail member and the trolley surrounds the rail member.

6. The volleyball service device of claim 5 wherein the trolley further includes at least one rotating contact surface contacting the rail member.

7. The volleyball service device of claim 1 wherein the server head includes means for removable attachment to the support means.

8. The volleyball service device of claim 7 wherein the server head is removably attached to a bracket.

9. The volleyball service device of claim 8 wherein the server head is attached to the bracket by means of a screw.

10. The volleyball service device of claim 9 wherein the server head is attached to the bracket by wing nut.

11. The volleyball service device of claim 1 wherein the base member further includes a raised platform.

12. The volleyball service device of claim 11 wherein the raised platform includes means for securing a person standing on the raised platform.

13. The volleyball service device of claim 12 wherein the raised platform includes a means for storing a supply of balls to be thrown.

14. A practice volleyball service apparatus comprising:

a base member;

a volleyball server head comprising;

a mounting frame;

at least one driven rotating wheel having a first driving surface, a first axis of rotation and a first plane of rotation attached to the mounting frame;

a second wheel having a second driving surface, a second axis of rotation, and a second plane of rotation attached to the mounting frame, wherein the first plane of rotation and the second plane of rotation are substantially the same, and the first axis of rotation and the second axis of rotation are offset enough to allow a sphere the approximate size of a volleyball to contact the first driving surface of the first wheel and the second driving surface of the second wheel simultaneously; and a feeding station suitably mounted on the mounting frame to allow placing volleyballs in wheel accessible position thereby allowing the driven rotating wheel and the second wheel to propel the volleyballs forward in the direction of volleyball travel;

a support having the frame vertically rotatably and horizontally rotatably attached thereto; and means for vertically repositioning the volleyball server head attached to the base and to the volleyball server head comprising;

a support inclined away from the direction of volleyball travel and inclined over the base member;

a bracket means for holding the volleyball server head vertically repositionable on the support mounted thereto; and a resilient means attached to the base member disposed in parallel orientation to the support, the resilient means allowing the support to maintain a selected vertical position and the support frame positioning the server nearer the center of the base member as the server is repositioned farther from the base member.

* * * * *